US011253025B2

(12) United States Patent
Martin

(10) Patent No.: US 11,253,025 B2
(45) Date of Patent: Feb. 22, 2022

(54) ASYMMETRIC SHOCK ABSORPTION FOR FOOTWEAR

(71) Applicant: Lee James Martin, Henniker, NH (US)

(72) Inventor: Lee James Martin, Henniker, NH (US)

( * ) Notice: Subject to any disclaimer, the term of this patent is extended or adjusted under 35 U.S.C. 154(b) by 941 days.

(21) Appl. No.: 15/884,656

(22) Filed: Jan. 31, 2018

(65) Prior Publication Data

US 2018/0220736 A1 Aug. 9, 2018

Related U.S. Application Data

(60) Provisional application No. 62/473,670, filed on Mar. 20, 2017, provisional application No. 62/455,774, filed on Feb. 7, 2017.

(51) Int. Cl.

| | |
|---|---|
| ***A43B 7/32*** | (2006.01) |
| ***A43B 13/18*** | (2006.01) |
| ***A43B 5/00*** | (2006.01) |
| ***A43B 13/14*** | (2006.01) |
| ***A43B 13/16*** | (2006.01) |
| ***A43B 13/12*** | (2006.01) |
| ***A43B 13/02*** | (2022.01) |

(52) U.S. Cl.

CPC ..... *A43B 13/141* (2013.01); *A43B 5/00* (2013.01); *A43B 7/32* (2013.01); *A43B 13/023* (2013.01); *A43B 13/127* (2013.01); *A43B 13/14* (2013.01); *A43B 13/16* (2013.01); *A43B 13/181* (2013.01); *A43B 13/186* (2013.01)

(58) Field of Classification Search

CPC ... A43B 13/141; A43B 13/181; A43B 13/186; A43B 13/16; A43B 13/127; A43B 13/14; A43B 13/023; A43B 13/183; A43B 21/32; A43B 5/00; A43B 7/32

See application file for complete search history.

(56) References Cited

U.S. PATENT DOCUMENTS

| | | | | |
|---|---|---|---|---|
| 6,115,943 | A * | 9/2000 | Gyr | A43B 13/141 36/28 |
| 6,282,814 | B1 * | 9/2001 | Krafsur | A43B 7/1425 36/27 |
| 7,654,014 | B1 * | 2/2010 | Moore | A43B 5/001 36/127 |
| 7,950,166 | B1 * | 5/2011 | Perenich | A43B 13/181 36/27 |

(Continued)

*Primary Examiner* — Katharine G Kane

(74) *Attorney, Agent, or Firm* — Michael Bujold; Jay Franklin

(57) ABSTRACT

A system and a method of asymmetric shock absorption and torsion cushioning for footwear. The asymmetric shock absorption system providing an upper plate attached to the upper section of the footwear and a lower plate attached to the lower section of the footwear. The upper plate may be in direct contact with or spaced apart from the lower plate. A flexible perimeter band extends around the entire perimeter of the sole of the footwear and permanently connects the upper section to the lower section of the footwear. The flexible perimeter band may have a low-profile and extend around only the perimeter of the upper and lower plates. The flexible perimeter band may wrap around one or more plate to provide for limited horizontal movement, e.g., lateral, longitudinal, or both lateral and longitudinal, between the upper section of the footwear and the lower section of the footwear.

19 Claims, 10 Drawing Sheets

(56) References Cited

U.S. PATENT DOCUMENTS 8,752,306 B2 * 6/2014 Goldston ..... A43B 13/182 36/27
9,380,830 B1 * 7/2016 Greenberg ..... A43B 13/189
9,388,873 B1 * 7/2016 Phipps ..... A47C 27/06
9,925,453 B1 * 3/2018 Tuli ..... A43B 3/0036
2001/0001520 A1 * 5/2001 Gyr ..... A43B 21/26 280/14.22
2002/0144430 A1 * 10/2002 Schmid ..... A43B 13/181 36/27
2003/0163933 A1 * 9/2003 Krafsur ..... A43B 7/1425 36/27
2004/0107601 A1 * 6/2004 Schmid ..... A43B 13/12 36/28
2005/0005472 A1 * 1/2005 Perenich ..... A43B 13/181 36/27
2005/0126039 A1 * 6/2005 LeVert ..... A43B 7/1425 36/27
2005/0166422 A1 * 8/2005 Schaeffer ..... A43B 13/181 36/27
2007/0107260 A1 * 5/2007 Pasternak ..... A43C 15/09 36/39
2007/0266593 A1 * 11/2007 Schindler ..... A43B 1/0009 36/28
2010/0269368 A1 * 10/2010 Nakatsuka ..... A43B 5/06 36/27
2012/0036739 A1 * 2/2012 Amos ..... A43B 7/1445 36/103
2012/0102785 A1 * 5/2012 Rodman ..... A43B 13/181 36/114
2012/0159810 A1 * 6/2012 Klassen ..... A43B 13/181 36/28
2012/0225741 A1 * 9/2012 Antolick ..... A63B 69/0059 473/452
2012/0285040 A1 * 11/2012 Sievers ..... A43B 13/183 36/27
2013/0192090 A1 * 8/2013 Smith, IV ..... A43B 13/182 36/103
2013/0312288 A1 * 11/2013 Colthurst ..... A43B 7/00 36/103
2014/0223781 A1 * 8/2014 Colin ..... A43B 13/127 36/103
2014/0325870 A1 * 11/2014 Lombardino ..... A43B 13/182 36/27
2015/0040435 A1 * 2/2015 Barnes ..... A43B 13/22 36/102
2015/0157088 A1 * 6/2015 Seo ..... A43B 1/0018 36/25 R
2015/0157091 A1 * 6/2015 Hsu ..... A43B 13/12 36/44
2016/0044992 A1 * 2/2016 Reinhardt ..... A43D 39/00 36/88
2016/0058122 A1 * 3/2016 Foxen ..... A43B 13/187 36/28
2016/0174658 A1 * 6/2016 Desmarais ..... A43B 13/181 36/29
2016/0262492 A1 * 9/2016 Fujita ..... A43B 13/125
2016/0360830 A1 * 12/2016 Mitsui ..... A43B 5/00

* cited by examiner

ASYMMETRIC SHOCK ABSORPTION FOR FOOTWEAR

CROSS REFERENCE TO RELATED APPLICATION

This application claims priority from U.S. Provisional Application Ser. No. 62/455,774, filed Feb. 7, 2017 and U.S. Provisional Application Ser. No. 62/473,670, filed Mar. 20, 2017; the disclosure of each of which are incorporated herein by reference in their entirety.

FIELD OF THE DISCLOSURE

The present disclosure relates to footwear and, more particularly, to footwear which provides an asymmetric shock absorption feature.

BACKGROUND OF THE DISCLOSURE

Athletic footwear is typically used for running, basketball, tennis and other sports or activities. The term tends to exclude footwear used for sports played on grass such as soccer and rugby, which incorporate cleats in the ground engaging surface. Some common attributes of an athletic footwear includes specific treads, flexible soles, and the ability to absorb impact. The footwear themselves are typically made of flexible compounds, such as dense rubber and other conventional components.

There are a variety of running footwear which are designed for different running styles and/or abilities. There are footwear for people with a gait manifesting as neutral, over pronating (when the foot rolls in) and over supinating (when the foot rolls out). Footwear for these situations often have a complex structure of "rubber" with plastic and/or metal stiffeners which restrict foot movement in one or more areas.

SUMMARY OF THE DISCLOSURE

It has been recognized that there is a need for athletic footwear that is comfortable to wear, but is designed to also reduce injury caused by torsion of the leg or foot.

One aspect of the present disclosure is to provide a system and a method which facilitates limited relative sliding movement between an upper section of the sole and a lower section of the sole in order to minimize the impact of the wearer of the footwear.

According to another aspect of the present disclosure, one or more pairs of parallel sliding/gliding plates are provided, in a face to face arrangement, which facilitate relative sliding/gliding movement between the upper section of the sole relative and the lower section of the sole.

According to a still further aspect of the present disclosure, a resilient band wraps completely around the entire perimeter of the parallel sliding/gliding plates or around the entire perimeter of the sole of the footwear. The flexible band is permanently connected to both the upper section and the lower section in order to permit relative movement, between the upper section and the lower section of the sole, while still limiting and confining such movement in generally a horizontal plane.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

The asymmetric shock absorption system of the present disclosure is designed to cushion the knees, ankles, and hips of the wearer of the footwear, during use, from pain and injury while also providing comfort, performance, and pain relief during running, hiking, walking and/or other activities. The asymmetric shock absorption system provides the wearer with torsion-cushioning during "angular-foot-impact" with the ground and during "angular-foot-push-off" from the ground. The asymmetric shock absorption system is a unique system of footwear components which allows the wearer's foot the benefit of multi-directional cushioning, e.g., lateral/horizontal "motion," "give" or "sway", without inhibiting the wearer's ability to run, hike, walk, exercise, etc.

According to one embodiment, the cushioning is achieved by way of gliding upper and lower plates arranged within the sole of the footwear. A bottom or downwardly facing surface of the gliding upper plate may be either slightly spaced from or directly in contact or engaged with a top or upwardly facing surface of the gliding lower plate. Regardless of the initial spacing or relationship of the upper and lower plates, the downwardly facing bottom surface of the gliding upper plate typically at least partially engages with the top or upwardly facing surface of the gliding lower plate when a wearer wears and stands on the footwear. During use, when the wearer applies both a downward and an angular or a horizontal force to the asymmetric shock absorption system, the upper plate (along with the upper and the foot supported on the upper plate) is able to move, slide or glide to and fro, in a limited and restrained manner, upon the upwardly facing upper surface of the lower plate.

Figure 1:
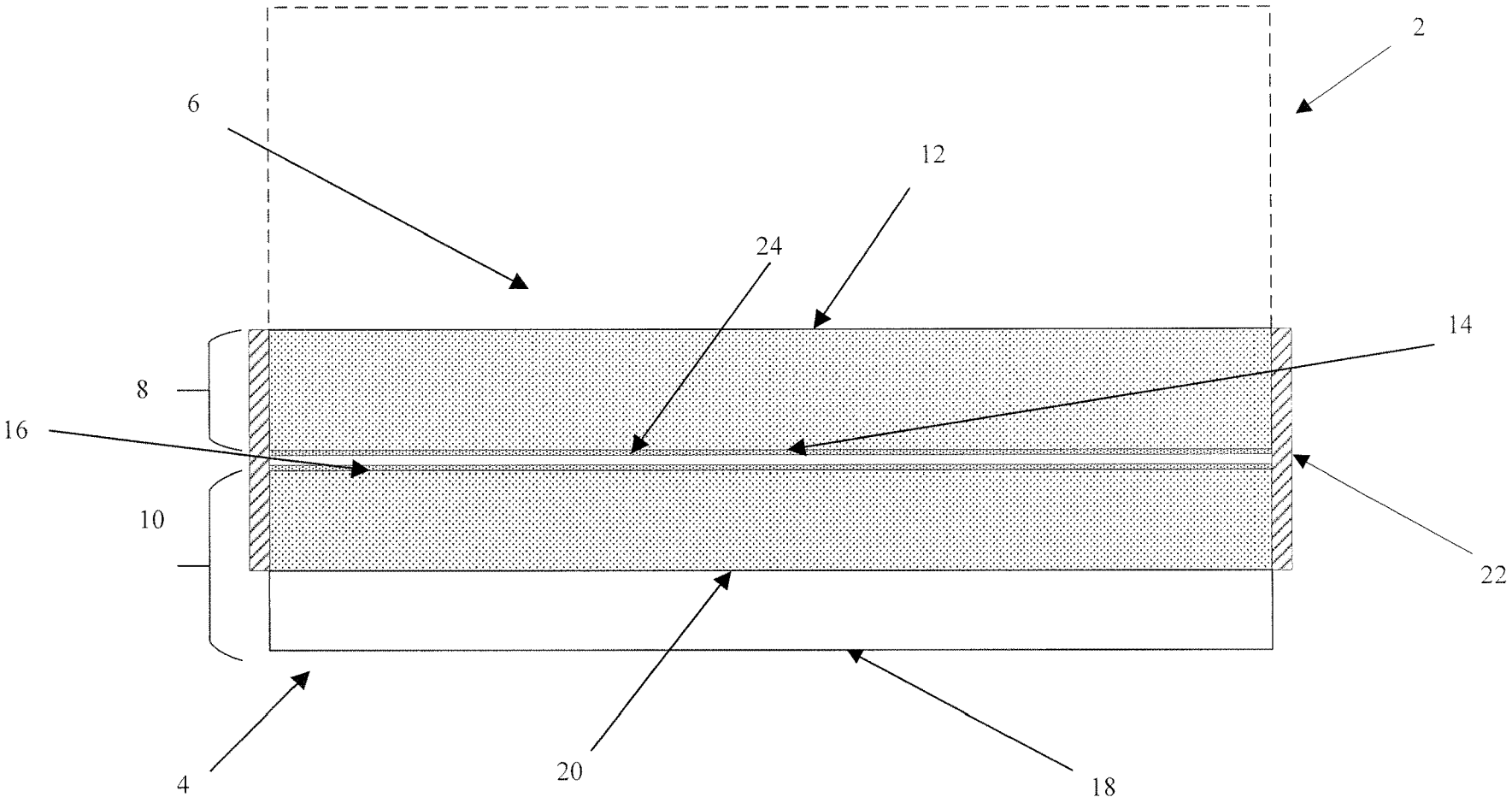
FIG. 1 is a diagrammatic view showing one embodiment of the asymmetric shock absorption system of the present disclosure for use in footwear.

Referring now to FIG. 1, a first embodiment of the asymmetric shock absorption system 2 of the present disclosure, for use in footwear, is shown and will now be described. More specifically, this Figure shows a diagrammatic cross-section of a footwear, incorporating the principle of the present disclosure. As shown, the footwear typically comprises a sole 4 and an "upper" 6 which is attached to and formed integral with the sole 4 of the footwear in a conventional manner. As such connection of the upper 6 to the sole 4 is conventional and well known in the art, a further detail discussion concerning the same is not provided.

The sole 4 of the footwear includes an upper section 8 and a lower section 10. An upper cushion layer 12 is attached to and forms a top or an upper surface of the upper section 8 of the sole 4. The cushion layer 12 is designed to engage with and support, along with the upper, the foot of the wearer when wearing the footwear. A gliding upper plate 14 is secured, e.g., by an adhesive for example, to a bottom or a downwardly facing surface of the cushion layer 12.

The lower section 10 of the sole 4 includes a gliding lower plate 16 which is located adjacent to and opposite the gliding upper plate 14. The gliding lower plate 16 generally extends or lies parallel to the gliding upper plate 14. At least a portion of the upper plate 14 may be in contact with the at least a portion of the lower plate 16 or, as generally shown, at least a portion of the upper plate 14 may be slightly spaced, e.g., 0.005 to 0.500 of an inch for example, from at least a portion of the lower plate 16. A lower-most portion of the lower section 10 of the sole 4 includes a ground engaging surface 18 which typically has a specific tread or other desired surface profile which is designed to maximize performance of the footwear when engaging the intended terrain. It is to be appreciated that a bottom cushion layer 20, as generally shown in FIG. 1 may be located between the lower plate 16 and the ground engaging surface 18 or possibly a bottom or downwardly facing surface of the lower plate 16 may directly engage with or be secured, e.g., by an adhesive for example, to a top or an upwardly facing surface of the ground engaging surface 18.

Figure 1A:
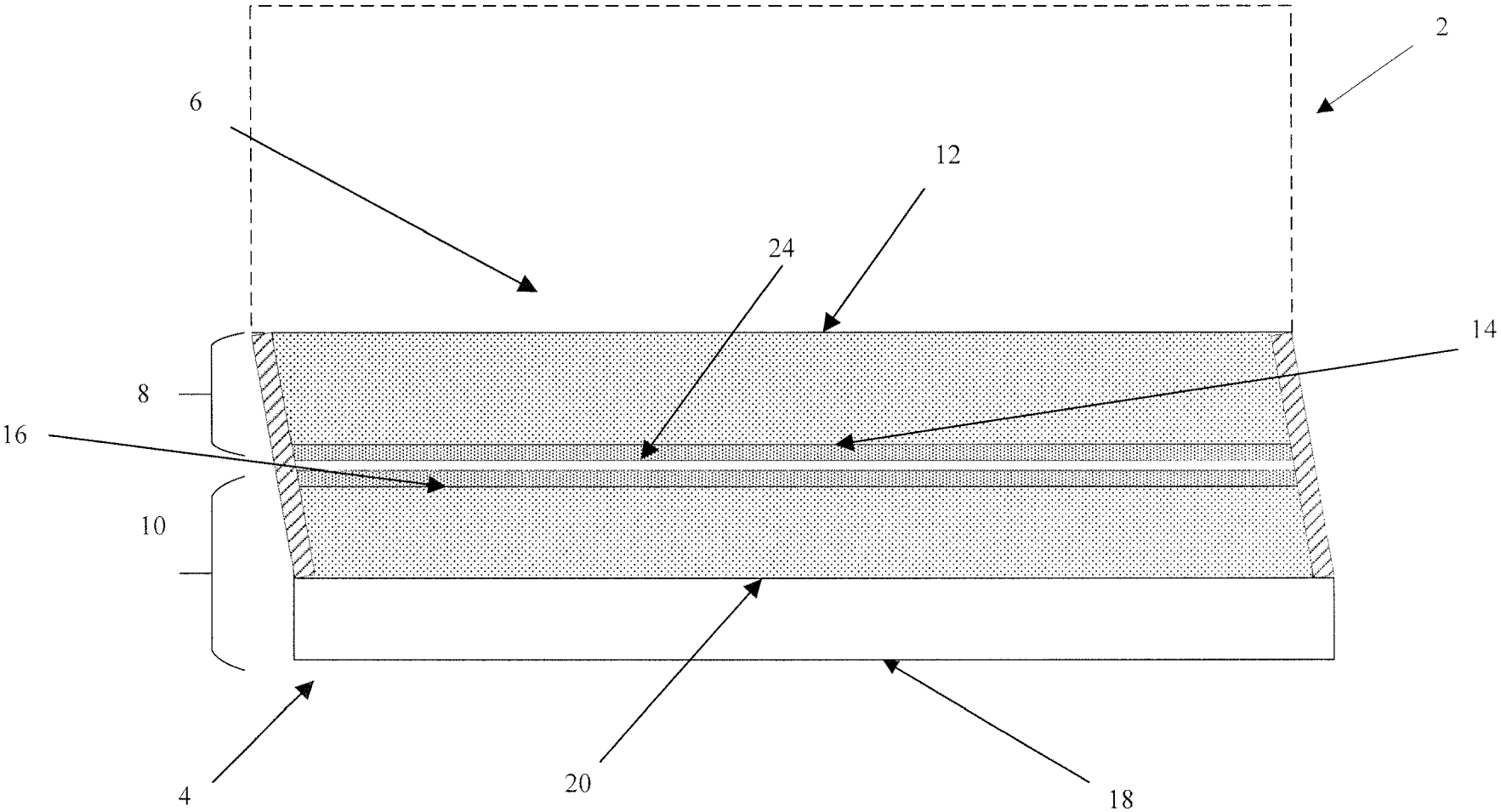
FIG. 1A is a diagrammatic view of the embodiment of FIG. 1 showing relative movement between the upper plate and the lower plate.

Both the upper plate 14 and the lower plate 16 are manufactured from a low friction material which facilitates relative sliding or gliding motion between the upper plate 14 and the lower plate 16, during use as shown in FIG. 1A. The upper plate 14 and the lower plate 16 are typically manufactured for the same material or, in some embodiments, the upper plate 14 may be manufactured from a different material than the lower plate 16. For example, both the upper and lower plates of the asymmetric shock absorption system may be manufactured from a Teflon™ sheet (i.e., polytetrafluoroethylene) or some other flexible, smooth surfaced plastic or metal sheet having a thickness of about 1/32 of an inch, for example.

In order to complete fabrication of the sole 4, a flexible perimeter band 22 wraps around the entire periphery of the sole 4 in order to limit or restrict the amount of relative movement that is permitted between the upper plate 14 and the lower plate 16. As generally shown, the flexible perimeter band 22 is permanently adhered or otherwise secured to an outwardly facing surface of both the upper section 8 and the lower section 10 of the sole 4. The flexible perimeter band 22 permits limited relative movement, between the upper plate 14 and the lower plate 16 (see FIG. 1A), while still retaining the lower section 10 permanently connected to the upper section 8 in order to maintain the integrity of the footwear. Typically, the facing surfaces of the upper plate 14 and the lower plate 16 are both smooth surfaces which assist with and facilitate the horizontal movement, e.g., lateral, longitudinal and/or combined lateral and longitudinal movement, relative to one another, while such horizontal movement still remains confined, limited and/or restricted by the flexible perimeter band 22.

The flexible perimeter band 22 may comprise, for example, synthetic rubber having a desired height and thickness. For example, the flexible perimeter band 22 has a thickness of between 0.125 to 0.25 of an inch and is generally permanently secured to both the upper section 8 and the lower section 10 of the sole 4. As noted above, a thin gap 24 (or empty space) may be formed between the upper plate 14 and the lower plate 16 or the plates may be in direct contact.

It is to be appreciated that the flexible and stretchable properties of the flexible perimeter band 22 control and limit the degree that the upper section 8, including the upper plate 14, the foot of the wearer and the upper 6 are allowed to glide and move relative to the lower plate 16 of the lower section 10. The motion may even include a twisting motion between the upper plate 14 and the lower plate 16. The greater angular force and/or horizontal force applied to the footwear by the user, the more the flexible perimeter band 22 will flex or stretch to allow more "give" and deflection between the upper section 8 and the lower section 10.

Figure 1B:
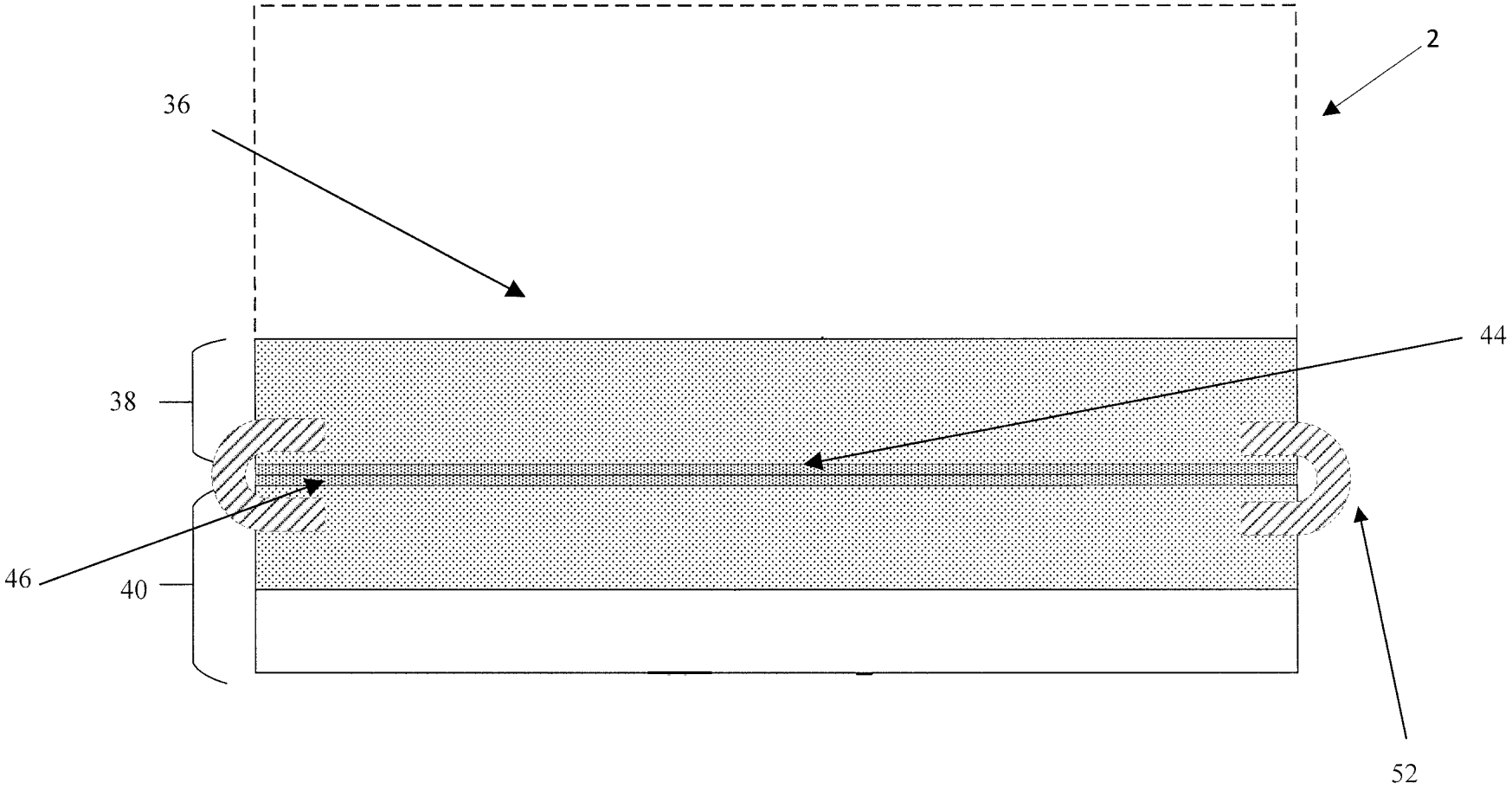
FIG. 1B is a diagrammatic view showing another embodiment of the asymmetric shock absorption system of the present disclosure for use in footwear.

Referring to FIG. 1B, a diagrammatic view showing another embodiment of the asymmetric shock absorption system of the present disclosure for use in footwear is shown. More specifically, this embodiment differs from the prior embodiment in a few significant ways. One difference is that there does not need to be a gap between the upper plate 44 and the lower plate 46. Instead, the smoothness of the upper and lower plates may provide sufficient movement relative to each other to provide the benefits of asymmetrical shock absorption. In order to complete fabrication of the footwear of this embodiment, and in order to limit or restrict the amount of relative movement that is permitted between the upper plate 44 and the lower plate 46, a flexible perimeter band 52 wraps around the entire periphery of upper and lower plates. In the embodiment, as generally shown, the flexible perimeter band 52 can form a "U" as viewed in cross section and surround at least the perimeter of the upper and lower plates. In some cases, the "U" can be formed using an adhesive flexible tape-like structure that wraps around the perimeter edges of the two mated plates and the remaining upper surface of the upper plate 44 and the remaining lower surface of the lower plate 46 are secured to the upper section 38 and to the lower section 40, respectively, using an adhesive (not shown).

Figure 1C:
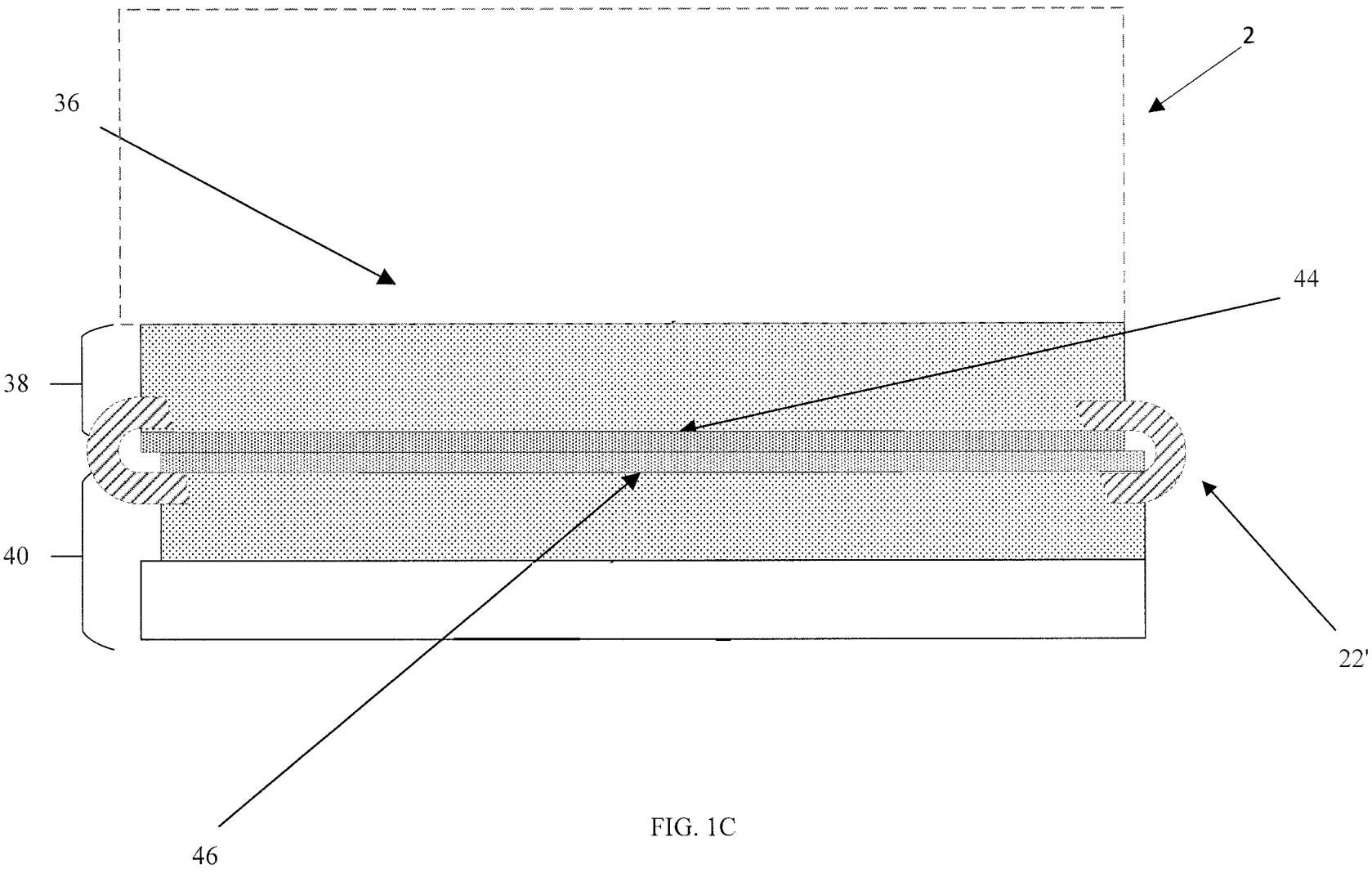
FIG. 1C is a diagrammatic view of the embodiment of FIG. 1B showing relative movement between the upper plate and the lower plate.
Figure 1D:
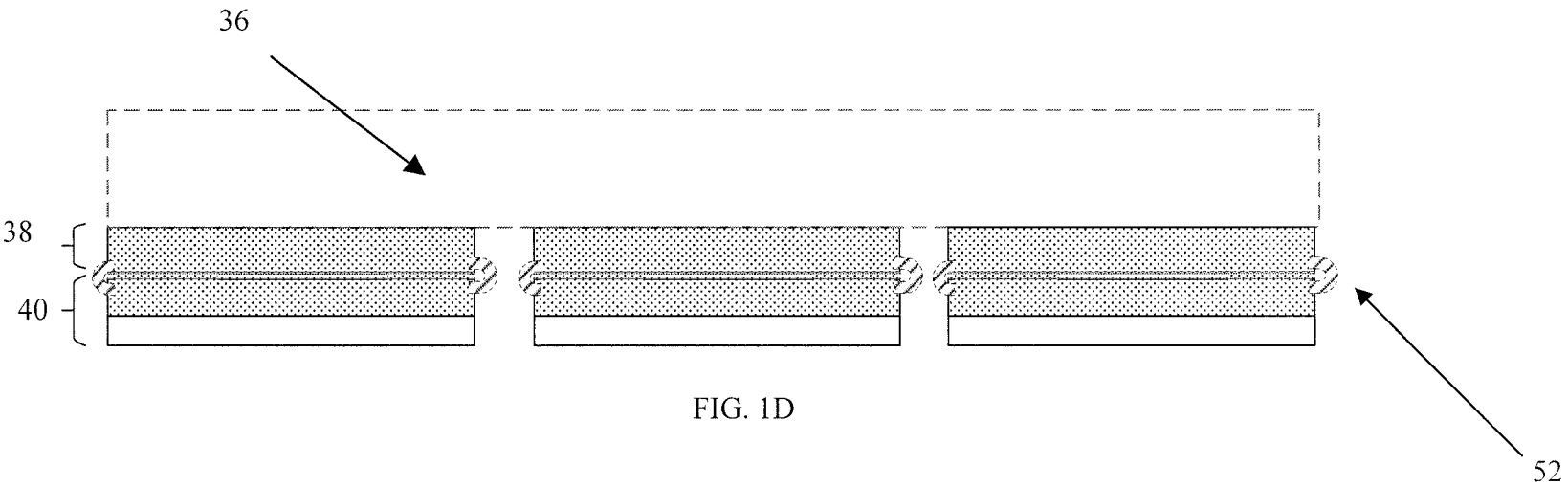
FIG. 1D is a diagrammatic view of yet another embodiment the asymmetric shock absorption system of the present disclosure for use in footwear.
Figure 1E:
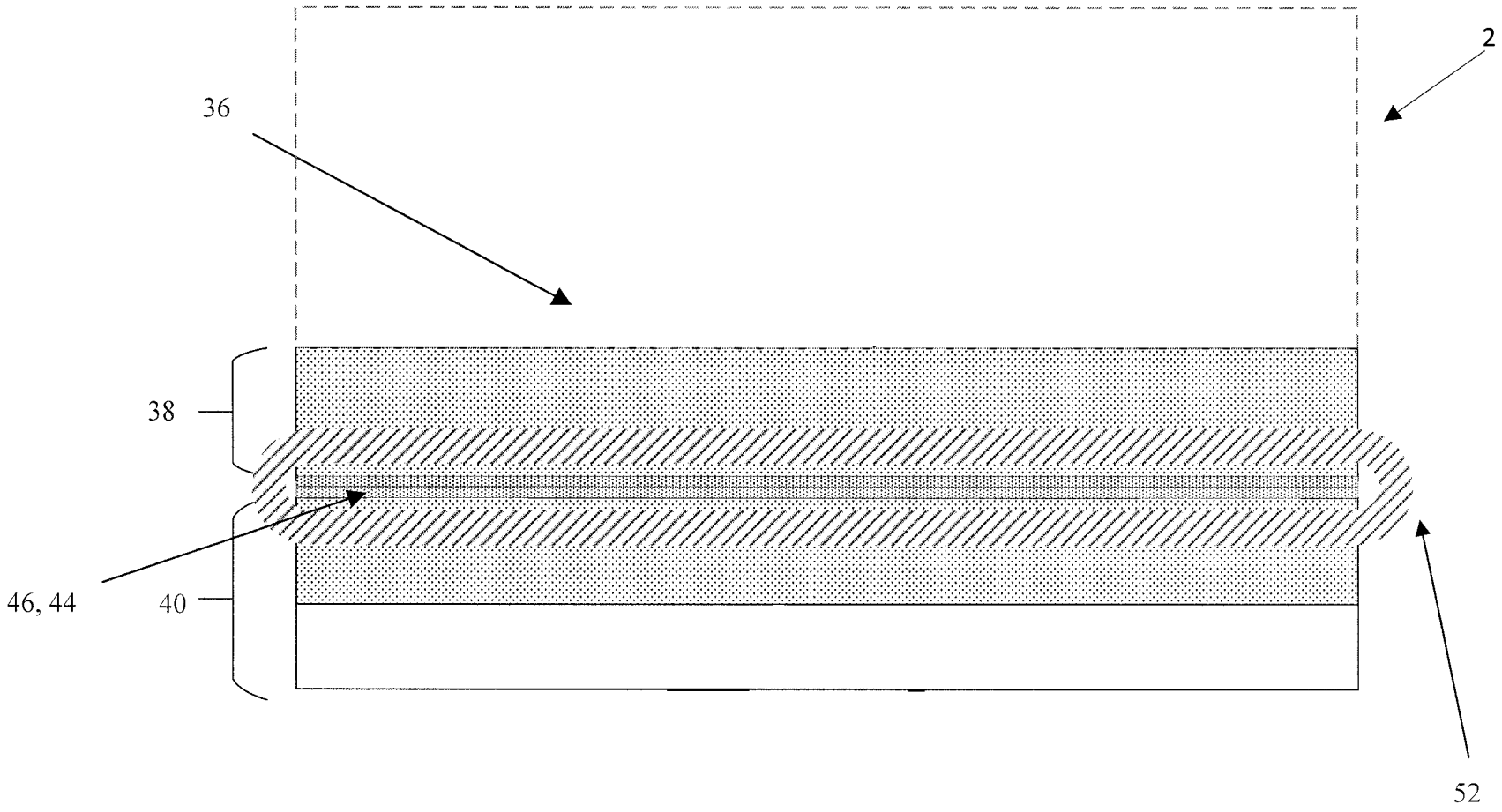
FIG. 1E is a diagrammatic view of yet another embodiment the asymmetric shock absorption system of the present disclosure for use in footwear.

Referring to FIG. 1E, in other embodiments the flexible perimeter band 52 wraps, or encases, the upper and lower plates such that their entirety is within the flexible perimeter band 52. This may be achieved by sliding the two mated plates into a flexible perimeter tube, or sock, or the like. The two flexible band-wrapped plates would then be permanently adhered or otherwise secured to a downward facing surface of the upper section 38 and an upward facing surface of the lower section 40, respectively, to form a footwear having asymmetrical shock absorption properties while having a low-profile perimeter band 52. The flexible perimeter band 52 permits limited relative movement, between the upper plate 44 and the lower plate 46 (See, e.g., FIG. 1C). Typically, the facing surfaces of the upper plate 44 and the lower plate 46 are both smooth surfaces which assist with and facilitate the horizontal movement, e.g., lateral, longitudinal and/or combined lateral and longitudinal movement, relative to one another, while such horizontal movement still remains confined, limited and/or restricted by the flexible perimeter band 52 as discussed herein. The flexible perimeter band 52 may comprise, for example, synthetic rubber having a desired height and thickness. For example, the flexible perimeter band 52 may have a thickness of between about 0.005 to about 0.25 of an inch. In certain embodiment of the present disclosure, the pair of mating plates (e.g., 44, 46) may be replaced by a single plate having smooth upper and lower surfaces to provide for gliding action as described herein.

It is to be appreciated that the flexible and stretchable properties of the flexible perimeter band 52 control and limit the degree that the upper section 38, including the upper plate 44, the foot of the wearer and the upper 36 are allowed to glide and move relative to the lower plate 46 of the lower section 40. The motion may even include a twisting motion between the upper plate 44 and the lower plate 46. The greater angular force and/or horizontal force applied to the footwear by the user, the more the flexible perimeter band 52 will flex or stretch to allow more "give" and deflection between the upper section 38 and the lower section 40.

Referring to FIG. 1D, a diagrammatic view of yet another embodiment the asymmetric shock absorption system of the present disclosure for use in footwear is shown. More specifically, this embodiment provides for a plurality of mating upper and lower plate pairs having a flexible perimeter band design 52 as shown and described in FIG. 1B and FIG. 1C. In some embodiments, there may be one set of upper and lower plates having a flexible perimeter band design 52 at the toe of the footwear and another set of upper and lower plates having a flexible perimeter band design 52 at the heel. In yet another embodiment, there may be more than two upper and lower plate pairs having a flexible perimeter band design 52 as shown and described in FIG. 1B and FIG. 1C located at various positions on the footwear.

The asymmetric shock absorption system of the present disclosure provides numerous benefits. First, it reduces foot and heel rolls, tendon and muscle pulls, tears, twists and sprains. Second, it absorbs shock and stress to knees, ankles, feet, shins, joints and bones. Third, it provides comfort, performance, and pain relief while running, hiking, walking or performing some other activity.

Figure 2:
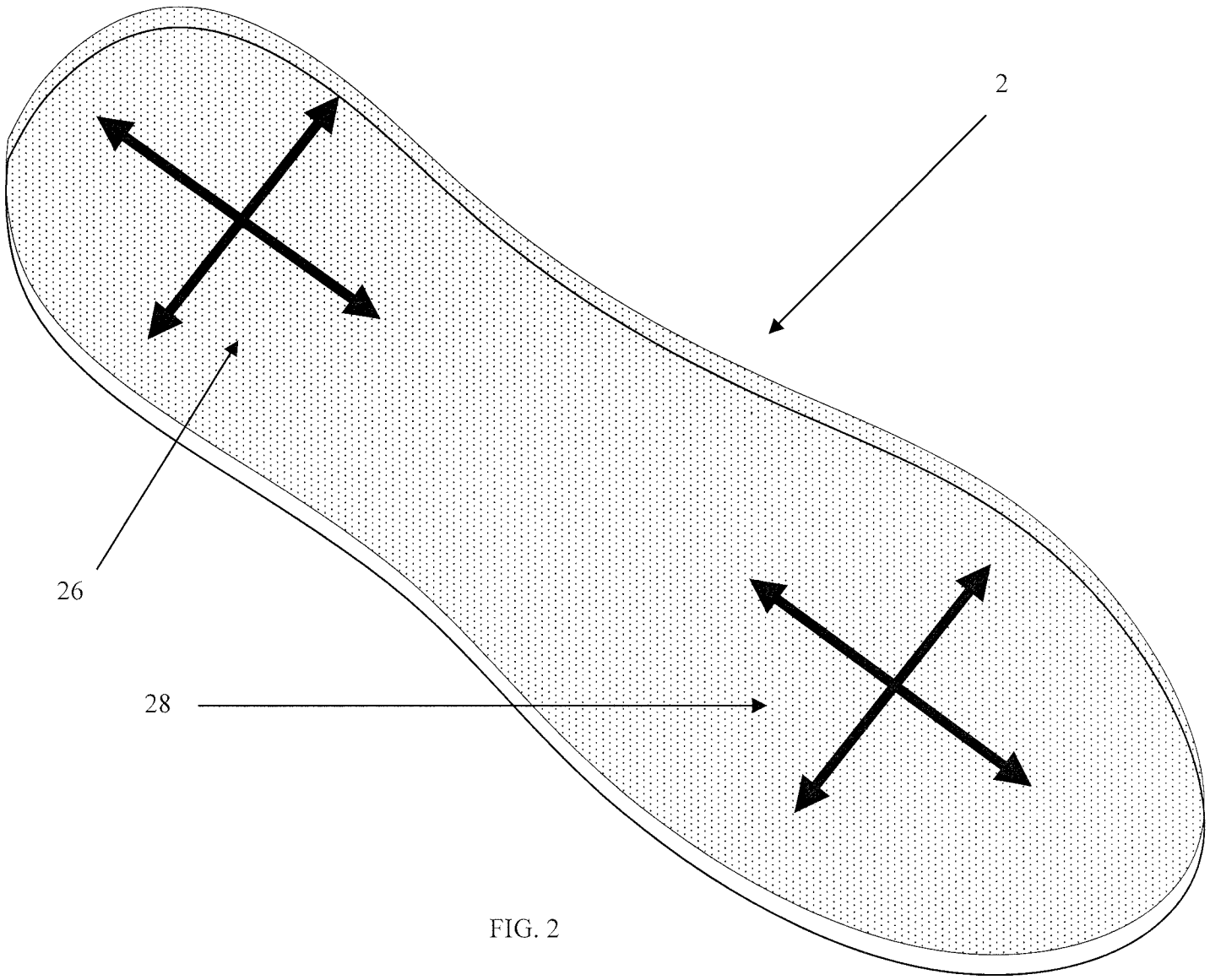
FIG. 2 is a diagrammatic view showing some of the possible ranges of motion provided by various embodiments of the asymmetric shock absorption system of the present disclosure.

Referring now to FIG. 2, this diagram shows some of the possible ranges of motion provided by the various embodiments of the asymmetric shock absorption system of the present disclosure. More specifically, the asymmetric shock absorption system 2 is integrated into an item of footwear. In some cases, the footwear comprises athletic footwear. When a user is wearing the footwear, there is vertical cushioning similar to conventional footwear, but the footwear, according to the present disclosure, also provides both lateral and/or longitudinal cushioning. Additionally, certain embodiments provide multi-lateral impact and thrust deflection by allowing the upper section 8, the foot, and the upper 6 to "move" or "give" in any horizontal direction. In this Figure, the heel arrows 26 represent "move" or "give" in the heel portion of the footwear, but it is understood that there is also play in a remainder of the footwear and that "movement" or "give" is not only in the directions shown by the depicted arrows 26. In the toe area of the footwear, the toe arrows 28 are similarity used to represent motion in any direction along the horizontal plane. In one embodiment, the footwear upper is able to "move" or "give" up to 5% of the total area occupied by the footwear's ground impact space (or foot print), for example.

Conventional footwear typically only provides cushioning against downward foot impact—which is only one dimensional shock absorption and does very little to aid against angular or lateral stress. In contrast, the asymmetric shock absorption system of the present disclosure provides a method of absorbing angular shock, strain, and stress exerted upon the tendons, ligaments, bones and muscles of the foot and leg during running, hiking, walking and other activities.

Figure 3:
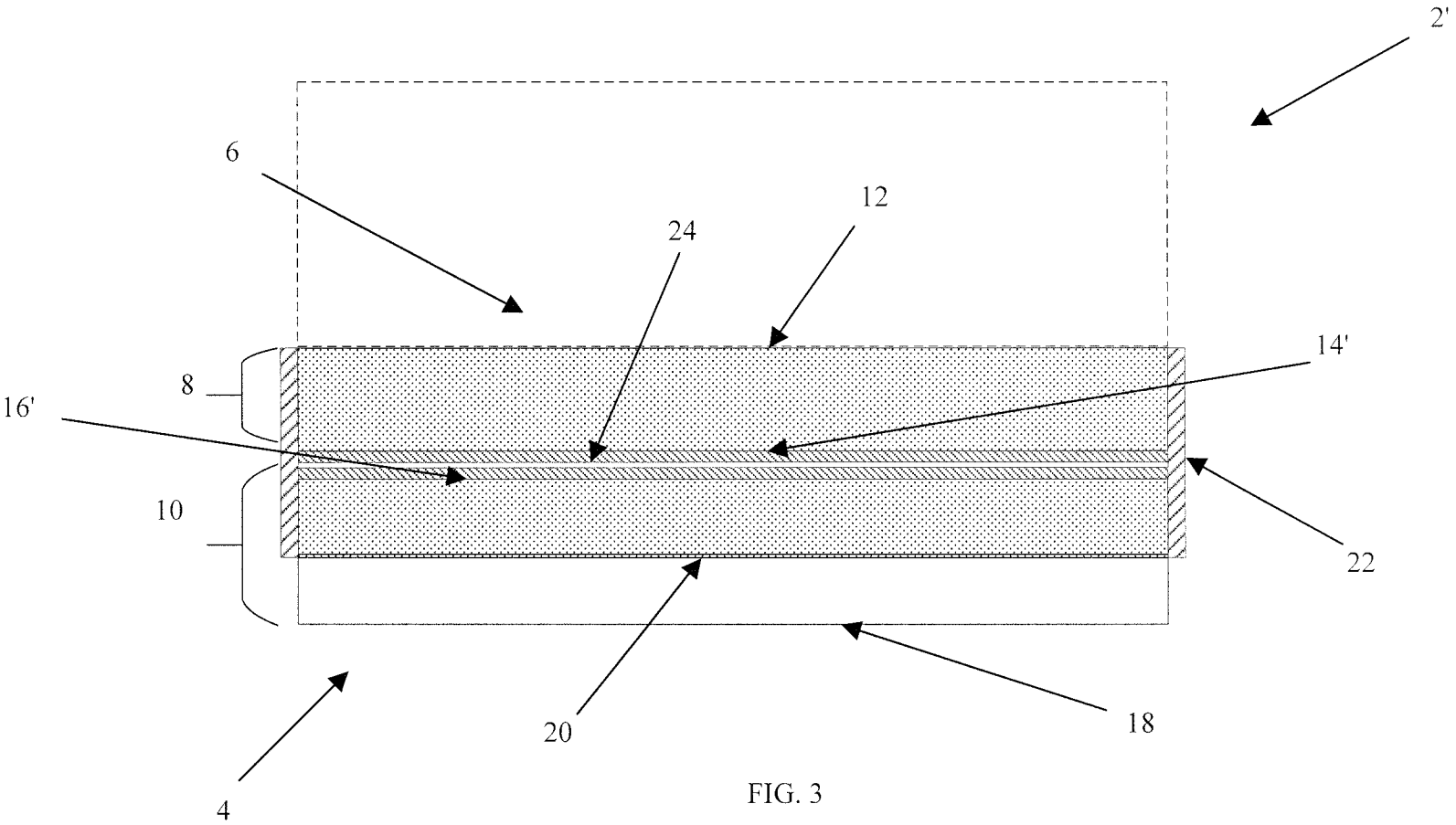
FIG. 3 is a diagrammatic view showing yet another embodiment of the asymmetric shock absorption system of the present disclosure for use in footwear.

Referring to FIG. 3, another embodiment of the asymmetric shock absorption system 2' of the present disclosure for use in footwear is shown. More specifically, the composition of the upper-plate 14' and the lower plate 16' are such that they are covered with micro surface texture to aid in limiting the amount of horizontal "move" or "give" experienced by the wearer.

Figure 4:
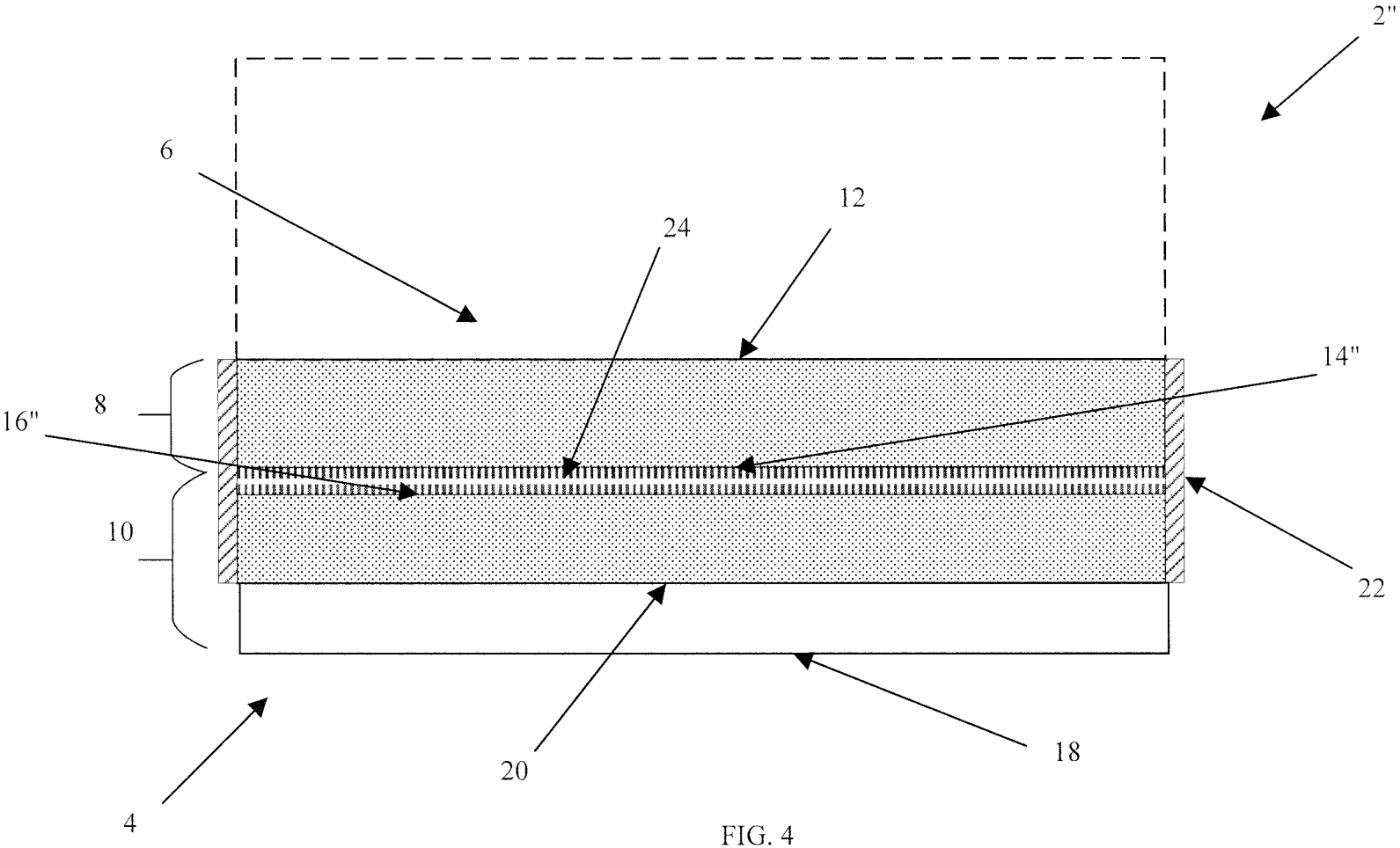
FIG. 4 is a diagrammatic view showing still another embodiment of the asymmetric shock absorption system of the present disclosure for use in footwear.

Referring to FIG. 4, yet another embodiment of the asymmetric shock absorption system 2" of the present disclosure for use in footwear is shown. There, the upper-plate 14" and the lower plate 16" each comprise an array of protrusions on the surface of each pate such that the protrusions on one plate 14" or 16" interact with the array of protrusions on the other plate 16" or 14" and provide a limited amount of horizontal movement or give in the footwear.

Figure 5A:
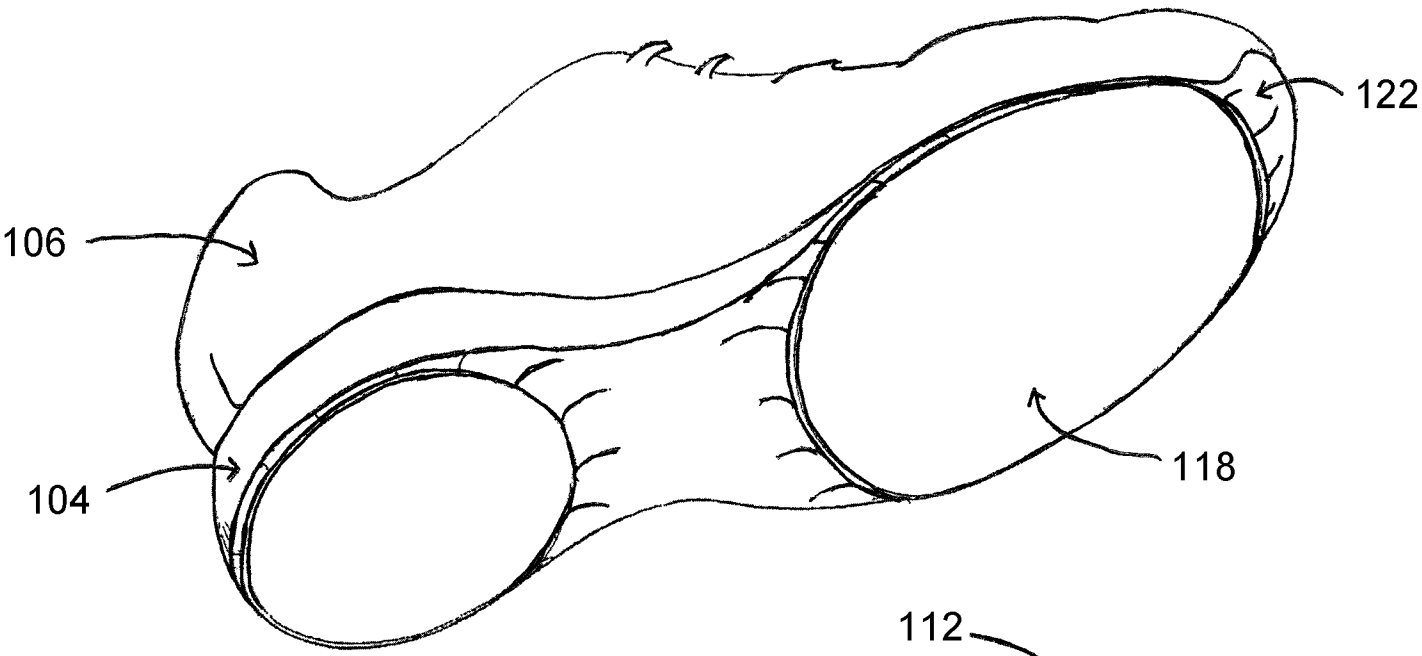
FIG. 5A is a diagrammatic view showing still another embodiment of the asymmetric shock absorption system of the present disclosure for use in footwear.

Referring to FIG. 5A, yet another embodiment of the asymmetric shock absorption system of the present disclosure for use in footwear is shown. More specifically, a "cup design" relating to using two or more, sliding plate cushioning devices having a flexible perimeter band, built into the sole of the shoe at two or more positions—thus having and providing contact with the ground at multiple points—versus previous embodiment of the asymmetric shock absorption technology for use with footwear having only "mono" or "a single" version of the pair of gliding plates with a flexible perimeter band surrounding and holding together the sole and upper cushion.

Figure 5B:
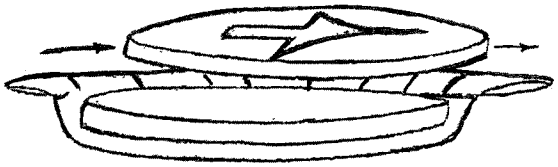
FIG. 5B is a diagrammatic view of the embodiment of FIG. 5A showing relative movement between the upper plate and the lower plate.

Referring to FIG. 5B, a diagrammatic view of the embodiment of FIG. 5A shows relative movement between the upper plate and the lower plate. It is understood that in one embodiment, all of the plurality of "cup" sections have the same properties and the same degree of flexibility. In other embodiments, the heel section and the toe section (in the case of a two "cup" model) may have different properties. In yet other embodiments, the use of multiple "cup" sections may provide for even greater specificity in glide properties along the perimeter of the shoe, for example.

Figure 5C:
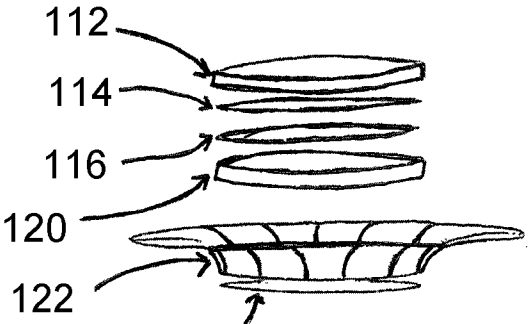
FIG. 5C is an exploded diagrammatic view showing the embodiment of FIG. 5A of the asymmetric shock absorption system of the present disclosure for use in footwear.

Referring to FIG. 5C, an exploded diagrammatic view of an embodiment of the asymmetric shock absorption system of the present disclosure is shown for use in footwear. There, an embodiment of the asymmetric shock absorption system of the present disclosure, for use in footwear, is shown and will now be described. More specifically, this Figure shows a diagrammatic cross-section of a section or "cup," incorporating the principles of the present disclosure. As shown, the footwear typically comprises a sole 104 and an "upper" 106 which is attached to and formed integral with the sole 104 of the footwear in a conventional manner. As such connection of the upper 106 to the sole 104 is conventional and well known in the art, a further detail discussion concerning the same is not provided.

An upper cushion layer 112 is attached to and forms a top or an upper surface of an upper section of the sole 104. The cushion layer 112 is designed to engage with and support, along with the upper, the foot of the wearer when wearing the footwear. A gliding upper plate 114 is secured, e.g., by an adhesive for example, to a bottom or a downwardly facing surface of the cushion layer 112.

A lower section of the sole 104 includes a gliding lower plate 116 which is located adjacent to and opposite the gliding upper plate 114. The gliding lower plate 116 generally extends or lies parallel to the gliding upper plate 114. At least a portion of the upper plate 114 may be in contact with the at least a portion of the lower plate 116 or, as generally shown, at least a portion of the upper plate 114 may be slightly spaced, e.g., 0.005 to 0.500 of an inch for example, from at least a portion of the lower plate 116. A lower-most portion of a lower section of the sole 104 includes a ground engaging surface 118 which typically has a specific tread or other desired surface profile which is designed to maximize performance of the footwear when engaging the intended terrain. It is to be appreciated that a bottom cushion layer 120, as generally shown in FIG. 5C may be located between the lower plate 116 and the ground engaging surface 118 or possibly a bottom or downwardly facing surface of the lower plate 116 may directly engage with or be secured, e.g., by an adhesive for example, to a top or an upwardly facing surface of the ground engaging surface 118.

Both the upper plate 114 and the lower plate 116 are manufactured from a low friction material which facilitates relative sliding or gliding motion between the upper plate 114 and the lower plate 116, during use as shown in FIG. 5B. The upper plate 114 and the lower plate 116 are typically manufactured for the same material or, in some embodiments, the upper plate 114 may be manufactured from a different material than the lower plate 116. For example, both the upper and lower plates of the asymmetric shock absorption system may be manufactured from a Teflon™ sheet (i.e., polytetrafluoroethylene) or some other flexible, smooth surfaced plastic sheet having a thickness of about 1/32 of an inch, for example.

In order to complete fabrication of the sole 104, a flexible perimeter band 122 wraps around the entire periphery of the sole 104 in order to limit or restrict the amount of relative movement that is permitted between the upper plate 114 and the lower plate 116. As generally shown, the flexible perimeter band 122 is permanently adhered or otherwise secured to an outwardly facing surface of both the upper section and the lower section of the sole 104. The flexible perimeter band 122 permits limited relative movement, between the upper plate 114 and the lower plate 116 (see FIG. 5B), while still retaining the lower section permanently connected to the upper section in order to maintain the integrity of the footwear. Here, the band is shaped in a "cup" like shape. It is understood that other configurations are also possible. In some embodiments, the flexible perimeter band may have a stepped appearance. It is also envisioned that more than two separate sections may be used.

Typically, the facing surfaces of the upper plate 114 and the lower plate 116 are both smooth surfaces which assist with and facilitate the horizontal movement, e.g., lateral, longitudinal and/or combined lateral and longitudinal movement, relative to one another, while such horizontal movement still remains confined, limited and/or restricted by the flexible perimeter band 122.

The flexible perimeter band 122 may comprise, for example, synthetic rubber having a desired height and thickness. For example, the flexible perimeter band 122 has a thickness of between 0.125 to 0.25 of an inch and is generally permanently secured to both the upper section and the lower section of the sole 104. As noted above, a thin gap 24 (or empty space) may be formed between the upper plate 114 and the lower plate 116.

It is to be appreciated that the flexible and stretchable properties of the flexible perimeter band 122 control and limit the degree that the upper section, including the upper plate 114, the foot of the wearer and the upper 106 are allowed to glide and move relative to the lower plate 116 of the lower section. The motion may even include a twisting motion between the upper plate 114 and the lower plate 116. The greater angular force and/or horizontal force applied to the footwear by the user, the more the flexible perimeter band 122 will flex or stretch to allow more "give" and deflection between the upper section and the lower section.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. An asymmetric shock absorption system for footwear comprising:

a sole comprising an upper section and a lower section;

the upper section comprising a cushion layer for engaging with a foot of a wearer, and a gliding upper plate being secured to a bottom downwardly facing surface of the upper section;

the lower section comprising a ground engaging surface for engaging with a desired surface, and a gliding lower plate being secured to an upwardly facing surface of the lower section;

at least a portion of the guiding upper plate being in direct contact with the gliding lower plate so as to permit lateral movement of the gliding upper plate relative to the gliding lower plate, during use, in any direction along a lateral plane; and a flexible perimeter band surrounding an entire perimeter of the gliding upper plate and the gliding lower plate and permanently adhering the upper section to the lower section of the sole such that the bottom downwardly facing surface of the upper section faces the upwardly facing surface of the lower section and permits limited relative lateral movement between the upper section and the lower section via relative sliding lateral movement between the upper gliding plate relative to the lower gliding plate.

2. The asymmetric shock absorption system for footwear according to claim 1, wherein the bottom downwardly facing surface of the upper gliding plate and the upwardly facing surface of the lower gliding plate are smooth surfaces.

3. The asymmetric shock absorption system for footwear according to claim 1, wherein the upper gliding plate and the lower gliding plate are made of the same material.

4. The asymmetric shock absorption system for footwear according to claim 1, wherein the flexible perimeter band is made of rubber, and the guiding upper plate and the guiding lower plate are manufactured from a low friction material which facilitates relative sliding or gliding motion between the guiding upper plate and the guiding lower plate.

5. The asymmetric shock absorption system for footwear according to claim 1, wherein there is more than one upper gliding plate and more than one lower gliding plate and a flexible perimeter band surrounds an entire perimeter of each mating pair of gliding upper and lower plates.

6. An asymmetric shock absorption system for footwear comprising:

an upper plate having a first surface and a second surface, the first surface being attached to a downwardly facing bottom surface of an upper section of a footwear;

a lower plate having a third surface and a fourth surface, the fourth surface being attached to an upper surface of a lower section of a footwear;

the upper plate being constantly in direct contact with the lower plate so as to permit lateral movement of the upper plate relative to the lower plate, during use, in any direction along a lateral plane; and a flexible perimeter band surrounding an entire perimeter of the gliding upper plate and the gliding lower plate and holding the upper plate and the lower plate in a position such that the upper section and the lower section of the footwear are connected and there is a gap is formed between the second surface of the upper plate and the third surface of the lower plate, and the flexible perimeter band permanently adhering the upper plate to the lower plate while only permitting limited relative lateral sliding movement between the upper plate relative to the lower plate;

thereby providing torsion cushioning to a wearer by affording limited multi-directional horizontal movement (lateral and/or longitudinal) between the upper section of the footwear and the lower section of the footwear.

7. The asymmetric shock absorption system for footwear according to claim 6, wherein the upper plate and the lower plate are made of the same material.

8. The asymmetric shock absorption system for footwear according to claim 6, wherein the second surface of the upper plate and the third surface of the lower plate are smooth.

9. The asymmetric shock absorption system for footwear according to claim 6, wherein the flexible perimeter band is made of rubber.

10. The asymmetric shock absorption system for footwear according to claim 6, wherein there is more than one upper plate and more than one lower plate.

11. An asymmetric shock absorption system for footwear comprising:

a sole comprising a upper section and a lower section;

the upper section comprising a cushion layer for engaging with a foot of a wearer, and a gliding upper plate being secured to a bottom downwardly facing surface of the upper section;

the lower section comprising a ground engaging surface for engaging with a desired surface, and a gliding lower plate being secured to an upwardly facing surface of the lower section;

the gliding lower plate lying generally parallel to the gliding upper plate and the guiding upper plate being constantly in direct contact with the gliding lower plate so as to permit lateral movement of the gliding upper plate relative to the gliding lower plate, during use, in any direction along a lateral plane; and a flexible perimeter band surrounding an entire perimeter of the gliding upper plate and the gliding lower plate and permanently adhering the gliding upper plate to the gliding lower plate while only permitting limited relative lateral movement via relative sliding movement between the upper gliding plate relative to the lower gliding plate.

12. The asymmetric shock absorption system for footwear according to claim 11, wherein the bottom downwardly facing surface of the gliding upper plate and the upwardly facing surface of the gliding lower plate are smooth surfaces.

13. The asymmetric shock absorption system for footwear according to claim 11, wherein the gliding upper plate and the gliding lower plate are made of the same material.

14. The asymmetric shock absorption system for footwear according to claim 11, wherein the flexible perimeter band is made of rubber.

15. The asymmetric shock absorption system for footwear according to claim 11, wherein there is no gap between the gliding upper plate and the gliding lower plate.

16. The asymmetric shock absorption system for footwear according to claim 11, wherein there is more than one gliding upper plate and more than one gliding lower plate.

17. The asymmetric shock absorption system for footwear according to claim 11, wherein the flexible perimeter band extends only around the perimeter of the gliding upper plate and the gliding lower plate.

18. The asymmetric shock absorption system for footwear according to claim 1, wherein the flexible perimeter band is in a form a U, when viewed in cross section, and surround at least the perimeter of both the gliding upper plate and the gliding lower plate.

19. The asymmetric shock absorption system for footwear according to claim 1, wherein both the gliding upper plate and the gliding lower plate are manufactured from polytetrafluoroethylene.

* * * * *